US011234575B2

(12) United States Patent
Enger et al.

(10) Patent No.: US 11,234,575 B2
(45) Date of Patent: Feb. 1, 2022

(54) SORBENT MOP BASE ASSEMBLY AND METHODS RELATED THERETO

(71) Applicant: Brady Worldwide, Inc., Milwaukee, WI (US)

(72) Inventors: Andrew N. Enger, Muskego, WI (US); Ryan J. Maloney, Milwaukee, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 98 days.

(21) Appl. No.: 16/777,691

(22) Filed: Jan. 30, 2020

(65) Prior Publication Data

US 2020/0253449 A1 Aug. 13, 2020

Related U.S. Application Data

(60) Provisional application No. 62/802,845, filed on Feb. 8, 2019.

(51) Int. Cl.

| | |
|---|---|
| ***A47L 13/46*** | (2006.01) |
| ***A47L 13/24*** | (2006.01) |
| ***A47L 13/16*** | (2006.01) |
| ***A47L 13/256*** | (2006.01) |
| ***A47L 13/257*** | (2006.01) |

(52) U.S. Cl.

CPC ..... *A47L 13/46* (2013.01); *A47L 13/16* (2013.01); *A47L 13/24* (2013.01); *A47L 13/256* (2013.01); *A47L 13/257* (2013.01)

(58) Field of Classification Search

CPC ..... A47L 13/20; A47L 13/24; A47L 13/25; A47L 13/254; A47L 13/256; A47L 13/42; A47L 13/44; A47L 13/46

USPC .... 15/147.1, 147.2, 149, 228, 231, 232, 233

See application file for complete search history.

(56) References Cited

U.S. PATENT DOCUMENTS

| | | | | |
|---|---|---|---|---|
| 659,168 | A * | 10/1900 | Foskett | 15/233 |
| 3,545,876 | A * | 12/1970 | Leland | A47L 13/29 401/201 |
| 4,010,508 | A * | 3/1977 | Komatsu | A47L 13/20 15/104.94 |
| 4,032,239 | A * | 6/1977 | Maupin | A47L 1/15 401/203 |
| 7,392,564 | B1 * | 7/2008 | Ferris | A47L 25/00 15/210.1 |
| D641,610 | S | 7/2011 | Sedalo | |
| D658,040 | S | 4/2012 | Ghatikar et al. | |
| D790,323 | S | 6/2017 | Fuglsang | |
| D902,012 | S | 11/2020 | Enger et al. | |
| 2008/0099646 | A1 | 5/2008 | Kobara et al. | |

(Continued)

OTHER PUBLICATIONS

Ecrandal Handmade Copper Cookie Cutters—Bread Slice—www.ecrandal.com/bread-slice/, Copyright 2020, 3 pages.

(Continued)

*Primary Examiner* — Mark Spisich

(74) *Attorney, Agent, or Firm* — Quarles & Brady LLP

(57) ABSTRACT

A mop base assembly includes a mop base and a sorbent pad. The mop base has a center portion with arms extending outward therefrom in which each of the arms have a hook member. The sorbent pad has attachment sections formed therein. Each of the attachment sections are receivable within a respective hook member of the mop base in order to attach the sorbent pad to the mop base.

10 Claims, 5 Drawing Sheets

(56) References Cited

U.S. PATENT DOCUMENTS

| | | | | |
|---|---|---|---|---|
| 2011/0020051 | A1* | 1/2011 | Robertson | A47L 13/254 401/268 |
| 2011/0107539 | A1* | 5/2011 | Dingert | A47L 13/256 15/231 |

OTHER PUBLICATIONS

Cookie Cutter: Slice of Bread, https://www.stifinder.com/model/cookie-cutter-slice-of-bread-znggNhtw/7868418/, posting date not given, 2 pages.

Coppergih is Workshop, CopperGifts: Slice of Bread Cookie Cutter—Small, https://www.amazon.com/CopperGifts-Slice-Bread-Cookie-Cutter/dp/B00455ZEAW, Date First Available: Sep. 29, 2010, 6 pages.

Ginger Bread Cookie Dough and Cookie Cutter, https://www.alamy.com/stock-photo-ginger-bread-cookie-dough-and-cookie-cutter-on-wooden-cutting-board-86388790.html, 2014, 1 page.

* cited by examiner

SORBENT MOP BASE ASSEMBLY AND METHODS RELATED THERETO

CROSS-REFERENCE TO RELATED APPLICATION

This application claims the benefit of U.S. Provisional Patent Application No. 62/802,845 filed Feb. 8, 2019 and entitled "Sorbent Mop Base Assembly and Methods Related Thereto" which is hereby incorporated by reference for all purposes as if set forth in its entirety herein.

FIELD OF INVENTION

This disclosure relates to a sorbent mop base with attachable and replaceable sorbent pads.

BACKGROUND

Mop or cleaning heads can get dirty quickly if they are performing their job well. As cleaning a dirty mop or cleaning device can be labor intensive, it is known to provide mops or cleaning devices in which a removable or replaceable cleaning head is attached to a handle. When the head becomes dirty, rather than cleaning the head, the head is simply removed and disposed of, and another cleaning head is attached for further cleaning using the device.

SUMMARY

Although the aforementioned replaceable cleaning heads permit dirty cleaning heads to often be removed with ease, there is a tradeoff between easy removal for replacement of the cleaning head and secure reception of the cleaning head on the cleaning device. Put differently, if the attachment mode is not robust, then the connection of the cleaning head to the cleaning device can potentially be disrupted during cleaning (for example, during the running of the cleaning head over a surface) which results in frustration of the end user.

Still further, certain cleaning head attachment designs can also be overly secure, making it difficult for the end user to remove the cleaning head from the cleaning device. Such a design can likewise result in user frustration as the user attempts to dislodge a firmly-secured and dirty disposable head to replace it with a clean one.

A mop base assembly is disclosed herein that provides a novel attachment of a sorbent pad to the mop base that is not overly cumbersome to the end user, not complicated in construction, and provides an attachment that is sufficiently robust for retaining the sorbent pad on the mop head.

According to one aspect, a mop base assembly includes a mop base and a sorbent pad. The mop base has a center portion with arms extending outward therefrom in which the arms each have a hook member. The sorbent pad has attachment sections formed therein. Each of the attachment sections are receivable within a respective hook member of the mop base to attach the sorbent pad to the mop base.

In some forms, each of the hook members may have a pair of hook elements projecting upward from the arm and facing each other with a bridge extending between and spacing apart the pair of hook elements defining a gap and a pocket. This space may be used to receive the corresponding attachment section of the sorbent pad.

In some forms, the mop base may have an X-shape with four arms each having a corresponding hook member disposed proximate an end thereof.

In some forms, the mop base may be attachable to a handle.

In some forms, the attachment sections may be integrally formed with the sorbent pad. For example, the attachment sections may be formed by die cutting two substantially parallel slots through the sorbent pad to provide a strip therebetween that serves as the attachment section. It is contemplated that the sorbent pad may be flexible to permit the strip to be flexed relative to a remainder of the sorbent body to accommodate insertion into the respective hook members.

According to another aspect, a method is disclosed for attaching a sorbent pad to a mop base. According to the method, a hook member of an arm of a mop base is inserted into an attachment section of a sorbent pad to engage the hook member with the attachment section. The mop base includes a plurality of arms each having a corresponding hook member and the sorbent pad includes a corresponding plurality of attachment sections for engagement with the corresponding hooks to attach the sorbent pad to the mop base.

In some forms, the hook member may have a pair of hook elements projecting upward from the arm and facing each other with a bridge extending between and spacing apart the pair of hook elements, defining a gap and a pocket. In such case, the step of inserting may include inserting the attachment section of the sorbent pad through the gap and into the pocket of the respective hook member.

In some forms, the mop base may have an X-shape with four arms each having a hook member disposed proximate an end thereof.

In some forms, the mop base may be attachable to a handle.

In some forms, the plurality of attachment sections may be integrally formed with the sorbent pad. For example, the attachment sections may be formed by die cutting two substantially parallel slots through the sorbent pad to provide a strip therebetween that serves as the attachment section. It is contemplated that the sorbent pad may be flexible to permit such strips to be flexed relative to a remainder of the sorbent body during attachment or removal of the sorbent pad.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Figure 1A:
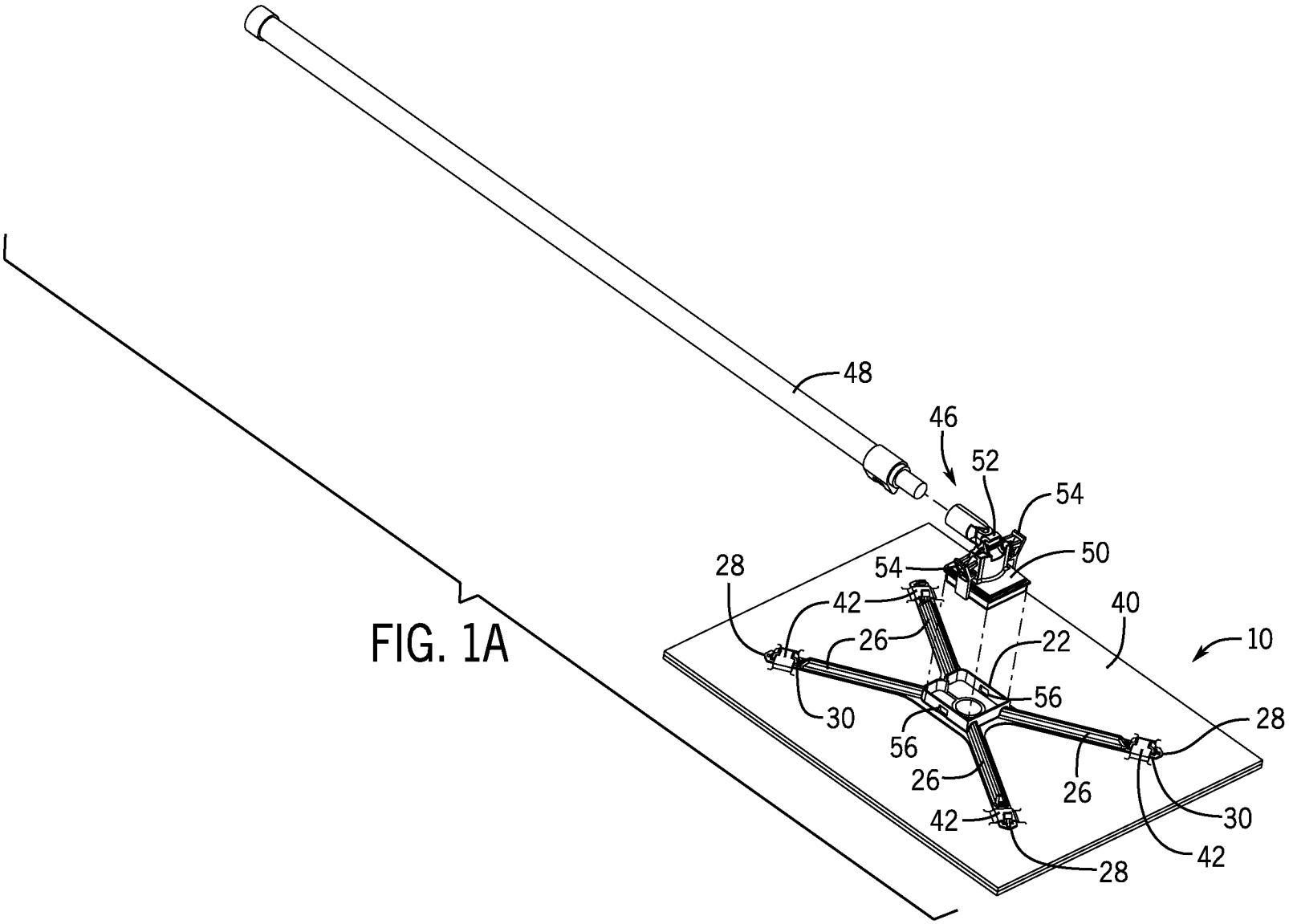
FIG. 1A is an exploded rear left perspective view of an embodiment of a mop base assembly and a handle component with the handle not yet attached to the mop base assembly.

Before any embodiments of the invention are explained in detail, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Some of the discussion below describe mop arrangements with mop bases and removable sorbent pads. The context and particulars of this discussion are presented as examples only. For example, embodiments of the disclosed product can include sorbent pads having attachment structures integrated therein and configured to receive retention elements of a mop base apart from those specifically illustrated. Still further, embodiments of the disclosed invention can be constructed from a variety of differently-shaped components that are assembled in various configurations, only some of which will be described herein.

Figure 1B:
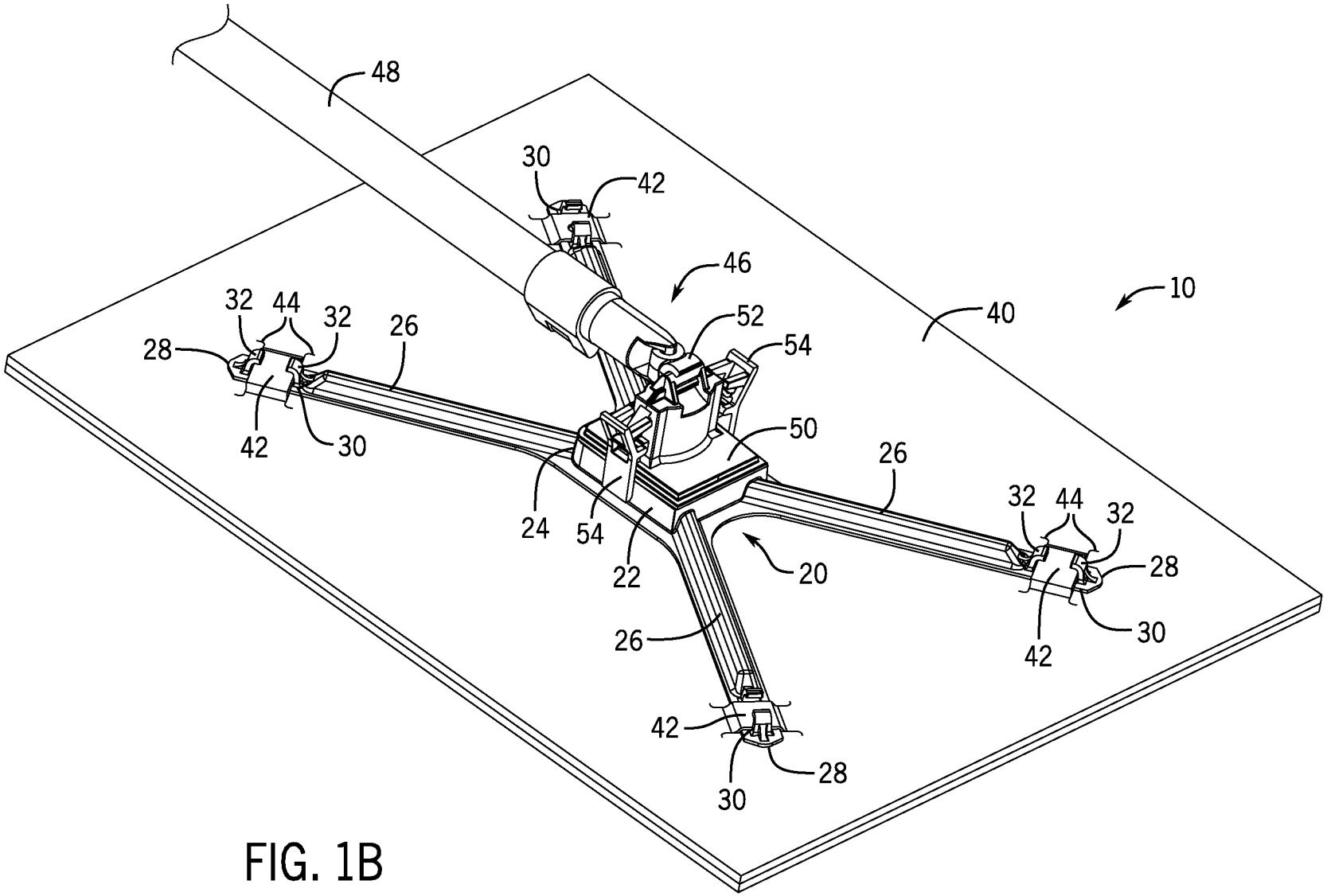
FIG. 1B is a rear left perspective view of the mop base assembly and the handle component of FIG. 1 after they have been assembled together.

FIGS. 1A and 1B illustrate an embodiment of a mop base assembly 10 and a removably attachable handle assembly 46 which together form a cleaning implement. The handle assembly 46 has handle member 48 and an attachment member 50. The handle member 48 can be a shaft-like elongate object and configured to be grasped by an operator to control the movement of the mop base assembly 10. The handle member 48 can be removably attachable or solidly fixed to the attachment member 50. The attachment member 50 can have a joint 52 to which the handle member 48 is coupled that allows the handle member 48 to rotate about the joint 52 relative to the attachment member 50.

Figure 2:
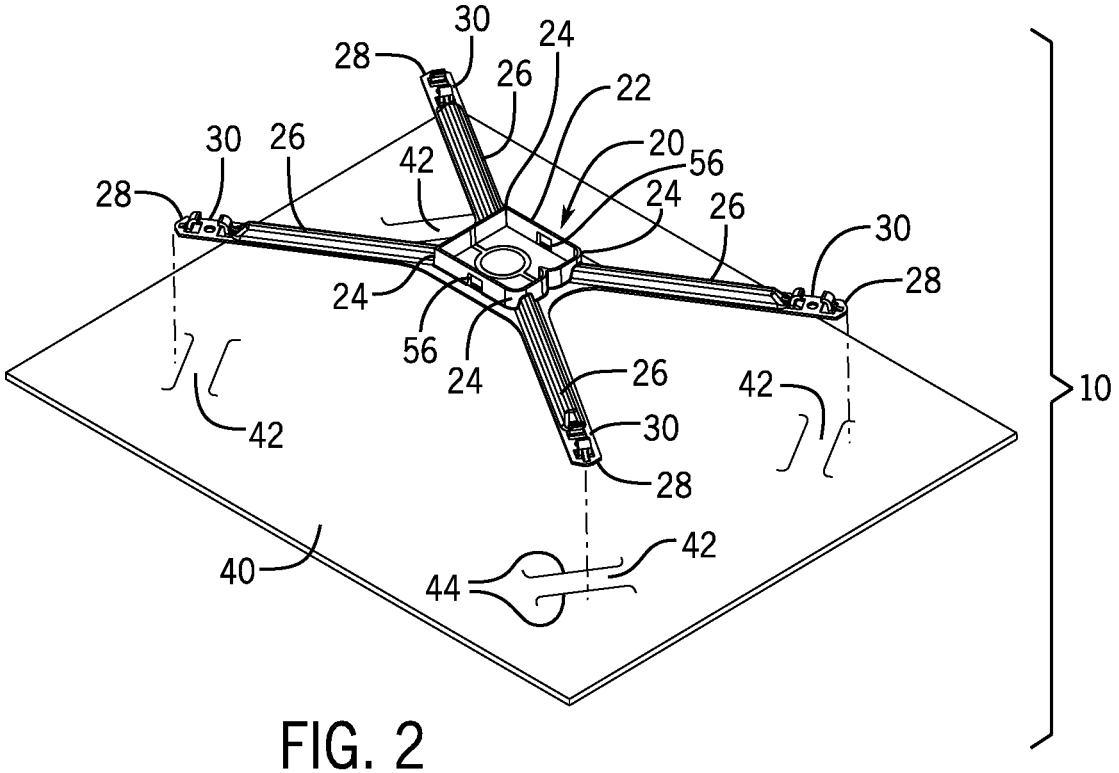
FIG. 2 is an exploded front right perspective view of the mop base assembly of FIGS. 1A and 1B including a mop base and sorbent pad prior to their assembly together.
Figure 3:
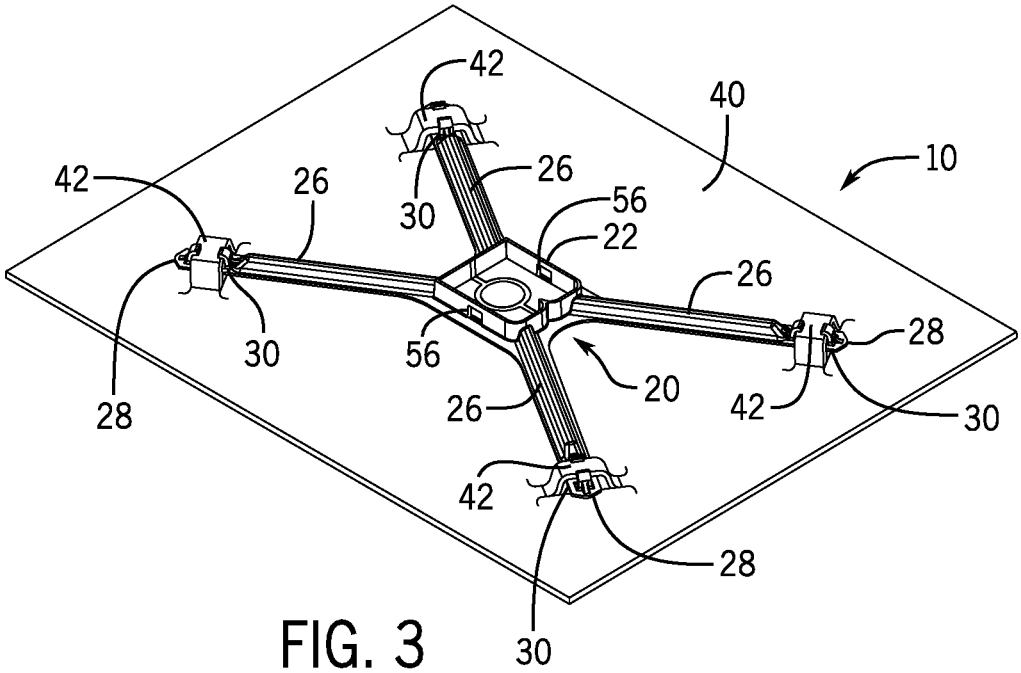
FIG. 3 is a front right perspective view of the mop base assembly of FIG. 2 in an assembled state in which the sorbent pad has been received on the mop base.

With further reference made to FIGS. 2 and 3, the mop base assembly 10 includes a mop base 20 and a sorbent pad 40 that is removably attachable to the mop base 20. The mop base 20 has a central portion 22 configured to removably engage with the attachment member 50 of the handle assembly 46. The central portion 22 can be substantially rectangular or square and can be provided in a shape, such as the letter "B" as illustrated.

The attachment member 50 is mateable with and retainable within the central portion 22. For example and as illustrated, the attachment member 50 can have clips 54 extending from the sides that are releasably retained within apertures 56 in the central portion 22. The clips 54 can be pliable members in that the clips 54 can maintain their engagement with the base 22 when mated but can be released by bending the clips 54 to disengage from the apertures 56. Other types of engagement mechanisms are also contemplated, however, for example, hook and loop fasteners, clasps, spring-plunger mechanisms, etc.

Figure 4:
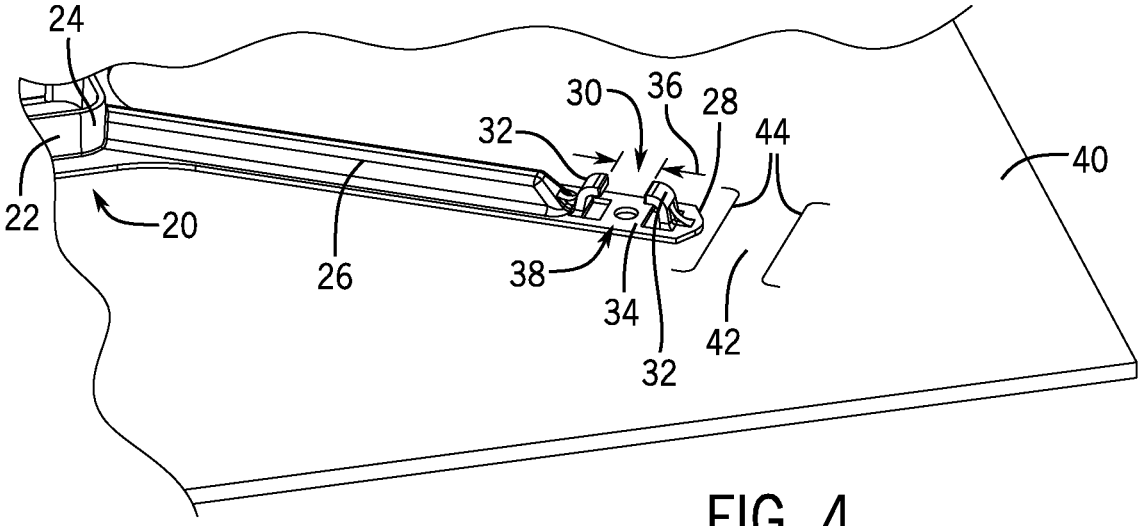
FIG. 4 is a perspective close-up view of a hook member of the mop base shown in FIG. 2 adjacent an attachment section of the sorbent pad prior to the flexure of the sorbent pad to provide an accessible strip or loop for attachment.

Continuing to look at FIGS. 2 and 3, four arms 26 are provided extending outwardly from each corner 24 of the substantially square central portion 22 of the mop base 20 along substantially the same plane and defining an overall "X" shape as viewed from above or below. Each of the four arms 26 has a hook member 30 provided at an end portion 28 of the four arms 26 as best shown in the detail of FIG. 4. The hook member 30 has hook elements 32 that extend upward from the plane along which the four arms 26 reside and face each other. A bridge portion 34 of the hook member 30 extends between and spaces the hook elements 32 apart defining a gap 36. The hook elements 32, in combination with the bridge portion 34, define a pocket 38.

The sorbent pad 40 is preferably substantially planar and rectangular in shape and formed from a sorbent material as is known in the art; however, other shapes and materials capable of similarly performing the objectives herein stated are also contemplated.

Figure 5:
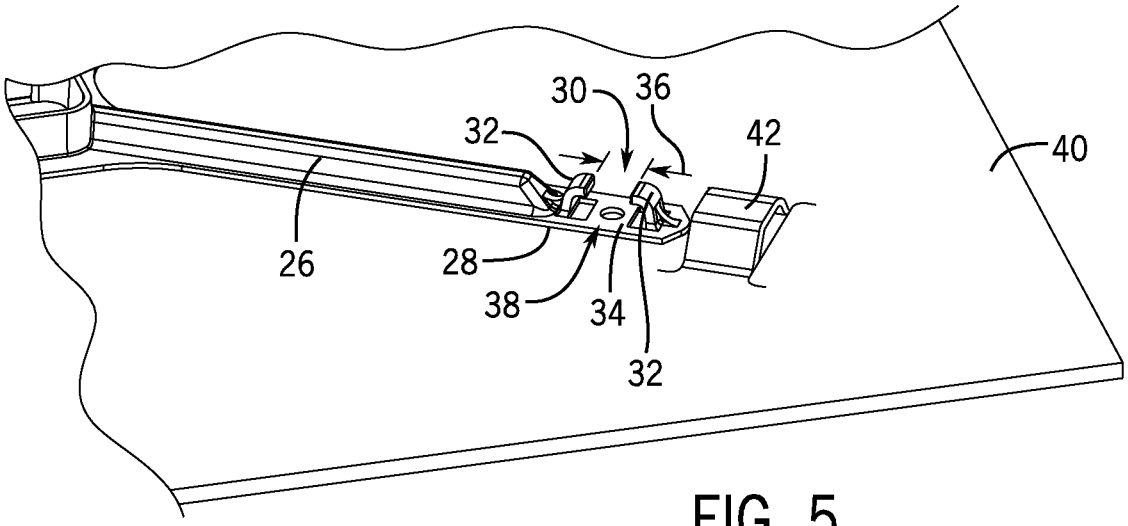
FIG. 5 is a perspective close-up view of the hook member and the attachment section as shown in FIG. 4 in which the attachment section has been flexed open to receive the hook member, but before reception of the attachment section of the pad in the hook member of the arm and before engagement of the hook member with the attachment section.

The sorbent pad 40 has four attachment sections 42 configured to be received within the hook members 30 of the mop base 20. Each attachment section 42 can be formed, for example, by the process of die cutting two substantially parallel slots 44 through the sorbent pad 40 as best illustrated in the detail of FIG. 4. The four attachment sections 42 are thereby integrally formed with rest of the sorbent pad 40 and can be flexibly manipulated, as described further below, to create a strip or loop of material as best shown in FIG. 5 through which one of the four arms 26 of the mop base 20 can be inserted to create points of attachment between the two. Additionally, or alternatively, a strip of material may be attached to the sorbent pad 40 (e.g., through adhesion, bonding, etc.) to provide a strip or loop of material for attachment. The interconnection of the hook members 30 and the attachment sections 42 provides an easily disengageable connection that is maintained through physical contact between the parts.

Figure 6:
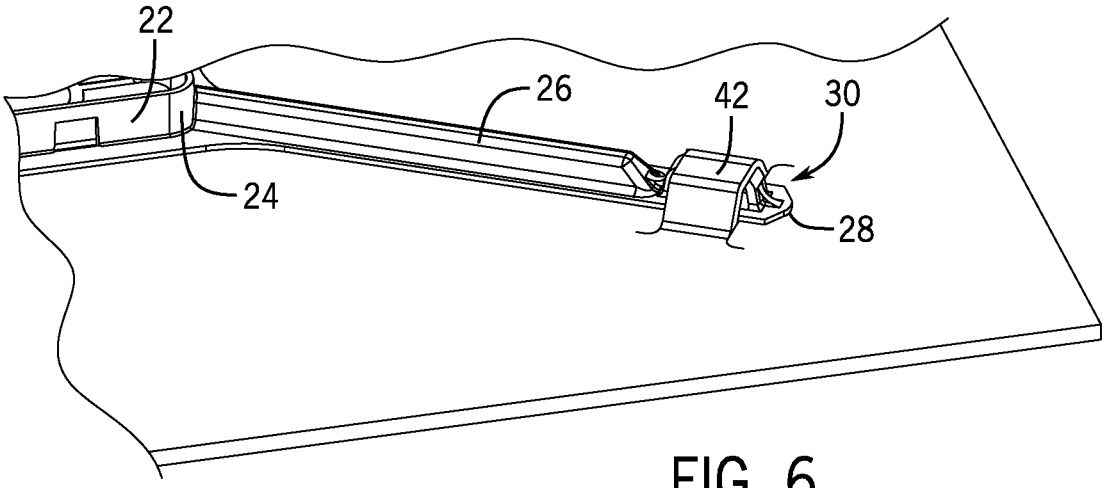
FIG. 6 is a perspective close-up view of the hook member and the attachment section as shown in FIG. 5 in which the hook member is received within the attachment section, but just prior to engagement between the attachment section and the hook member.
Figure 7:
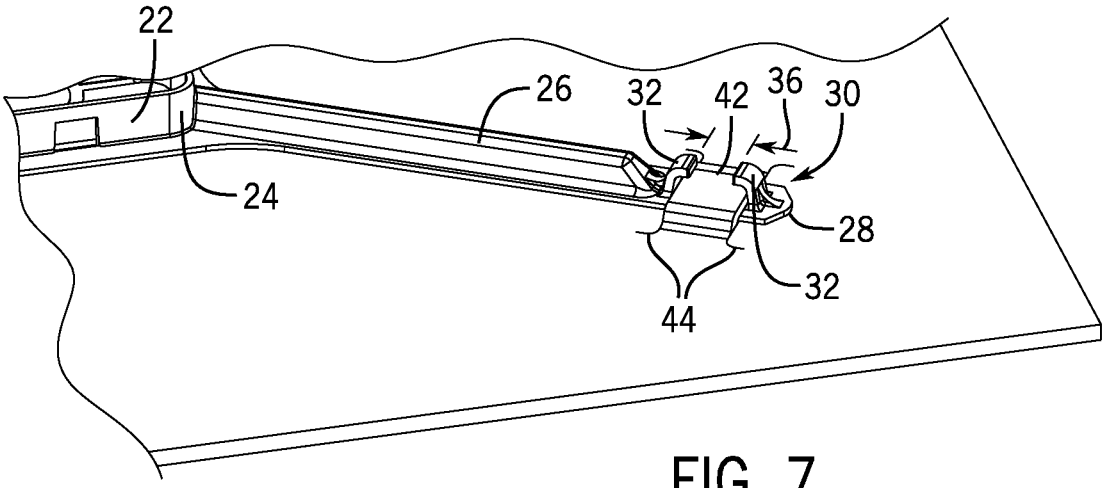
FIG. 7 is a perspective close-up view of the hook member and the attachment section as shown in FIG. 4 in which the hook member is received within and engaged with the attachment section to form an attachment point between them.

With reference now to FIGS. 4-7, a method for attaching a sorbent pad 40 to a mop base 20 is stepwise depicted according to an exemplary embodiment of the invention. FIG. 4 shows one of the four arms 26 of the mop base 20 adjacent to one of the four attachment sections 42 of the sorbent pad 40. FIG. 5 illustrates the attachment sections 42 substantially separated from the rest of the sorbent pad 40 to form a strip or loop of material configured to receive the hook member 30 of the arm 26. FIG. 6 demonstrates the reception of the hook member 30 of the arm 26 within the attachment section 42 of the sorbent pad 40 after it has been separated to form the loop. Finally, FIG. 7 shows the attachment section 42 being placed and fully received within the pocket 38 of the arm 26 after having been inserted through the gap 36 so that the hook member 30 captures the loop of the attachment section 42 in place to form a connection or attachment point between the two.

It will be observed that the detail of the attachment from FIGS. 4-7 can be performed at each of the various ends to fully, mechanically attach the pad 40 to the mop base 20. As illustrated, this is four separate points of connection The pad 40 may be somewhat flexible and pliable so that the engagement made at any particular point of connection does not inhibit the others points of connection from being formed due to tautness of the pad 40. Because of the two-sided hook member design at each point of connection, even with a bit of slack across the pad 40, it would be difficult for the pad 40 to be detached from the hook members 30 during use without intentional local manipulation of the attachment sections 42 of the pad 40 to disengage it from the respective hook member 30. Put differently, regardless of the direction in which the pad 40 is shifted in the plane of the pad 40 during use, the opposing hooks 32 help to maintain engagement and positioning of the pad 40 relative to the mop base 20 on which the pad 40 is received at each of the connection points.

As noted above, it should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A mop base assembly comprising:

a mop base having a center portion with arms extending outward therefrom, the arms each having a hook member with a pair of hook elements projecting upward from the arm and facing each other with a bridge extending between and spacing apart the pair of hook elements defining a gap and a pocket; and a sorbent pad having attachment sections formed therein, each of the attachment sections receivable within a respective hook member of the mop base to attach the sorbent pad to the mop base.

2. The mop base assembly of claim 1, wherein the mop base has an X-shape with four arms each having a corresponding hook member disposed proximate an end thereof.

3. The mop base assembly of claim 1, wherein the mop base is attachable to a handle.

4. A method for attaching a sorbent pad to a mop base, the method comprising:

inserting a hook member of an arm of a mop base into an attachment section of a sorbent pad to engage the hook member with the attachment section;

wherein the mop base includes a plurality of arms each having a corresponding hook member, each hook member of the plurality of arms has a pair of hook elements projecting upward from the respective arm and facing each other with a bridge extending between and spacing apart the pair of hook elements, defining a gap and a pocket, and the sorbent pad includes a corresponding plurality of attachment sections for engagement with the corresponding hooks to attach the sorbent pad to the mop base;

wherein the step of inserting includes inserting the attachment section of the sorbent pad through the gap and into the pocket of the respective hook member.

5. The method of claim 4, wherein the mop base has an X-shape with four arms each having a corresponding hook member disposed proximate an end thereof.

6. The method of claim 4, wherein the mop base is attachable to a handle.

7. A mop base assembly comprising:

a mop base having a center portion with arms extending outward therefrom, the arms each having a hook member; and a sorbent pad having attachment sections integrally formed therein, the attachment sections are formed by die cutting two substantially parallel slots through the sorbent pad to provide a strip therebetween that serves as the attachment section;

each of the attachment sections receivable within a respective hook member of the mop base to attach the sorbent pad to the mop base.

8. The mop base assembly of claim 7, wherein the sorbent pad is flexible to permit the strip to be flexed relative to a remainder of the sorbent pad.

9. A method for attaching a sorbent pad to a mop base, the method comprising:

inserting a hook member of an arm of a mop base into an attachment section of a sorbent pad to engage the hook member with the attachment section;

wherein the mop base includes a plurality of arms each having a corresponding hook member and the sorbent pad includes a corresponding plurality of attachment sections for engagement with the corresponding hooks to attach the sorbent pad to the mop base, the plurality of attachment sections are integrally formed with the sorbent pad by die cutting two substantially parallel slots through the sorbent pad to provide a strip therebetween that serves as the attachment section.

10. The method of claim 9, wherein the sorbent pad is flexible to permit the strip to be flexed relative to a remainder of the sorbent pad.

* * * * *